US008286902B2

(12) United States Patent
Lesar et al.

(10) Patent No.: US 8,286,902 B2
(45) Date of Patent: Oct. 16, 2012

(54) GRINDER WITH EXPANSION ZONE

(75) Inventors: Nick J. Lesar, Palmyra, WI (US); Christopher E. Albrecht, Cambridge, WI (US); E. William Wight, Roscoe, IL (US)

(73) Assignee: Weiler and Company, Inc., Whitewater, WI (US)

( * ) Notice: Subject to any disclaimer, the term of this patent is extended or adjusted under 35 U.S.C. 154(b) by 0 days.

(21) Appl. No.: 13/113,430

(22) Filed: May 23, 2011

(65) Prior Publication Data

US 2011/0220749 A1 Sep. 15, 2011

Related U.S. Application Data

(62) Division of application No. 12/146,146, filed on Jun. 25, 2008, now Pat. No. 7,946,517.

(60) Provisional application No. 60/946,301, filed on Jun. 26, 2007.

(51) Int. Cl.
*B02C 18/30* (2006.01)

(52) U.S. Cl. ..... 241/82.5

(58) Field of Classification Search ..... 241/82.1, 241/82.5, 82.6, 260.1
See application file for complete search history.

(56) References Cited

U.S. PATENT DOCUMENTS

| | | | | | |
|---|---|---|---|---|---|
| 800,452 | A | * | 9/1905 | Kohn | 241/82.4 |
| 1,350,164 | A | | 8/1920 | Loichot | |
| 1,435,796 | A | * | 11/1922 | Bennett | 241/82.4 |
| 1,619,632 | A | | 3/1927 | Perrault et al. | |
| 2,200,786 | A | * | 5/1940 | Ardrey | 241/82.4 |
| 2,229,845 | A | * | 1/1941 | Gold | 241/82.4 |
| 2,445,037 | A | | 7/1948 | Richard | |
| 2,633,170 | A | * | 3/1953 | Balmain | 99/494 |
| 2,665,725 | A | | 1/1954 | Lundell | |
| 2,693,348 | A | * | 11/1954 | Ellermann | 366/85 |
| 2,910,726 | A | | 11/1959 | Parshall et al. | |
| 3,362,044 | A | * | 1/1968 | Irving | 425/202 |
| 3,570,569 | A | | 3/1971 | Hartley et al. | |
| 3,971,514 | A | * | 7/1976 | Martinelli et al. | 241/82.4 |
| 3,984,056 | A | * | 10/1976 | Hartley | 241/82.1 |
| 4,108,387 | A | | 8/1978 | Weiler | |
| 4,844,372 | A | | 7/1989 | Weiler et al. | |
| 5,056,688 | A | | 10/1991 | Goetz et al. | |
| 5,443,214 | A | | 8/1995 | Lesar | |
| 5,628,466 | A | | 5/1997 | Haack et al. | |

* cited by examiner

*Primary Examiner* — Faye Francis
(74) *Attorney, Agent, or Firm* — Boyle Fredrickson, S.C.

(57) ABSTRACT

A grinding machine has a shearing chamber that includes one or more edges that provide fulcrum points against which frozen block of material, such as frozen blocks of meat, can be held against during a reduction or shearing process. The edges may be arranged to limit the advancement of reduced blocks of material to provide more control on the size of the ground material that is ultimately output by the grinding machine. The grinding machine may also include an expansion zone into which reduced blocks can be temporarily held to accommodate volume increases during the reduction process. A feed screw advances the frozen blocks through the shearing chamber and includes pressure fighting to help shear material from the frozen blocks. The feed screw may include a knife holder that provides support for a knife held therein against the lateral forces experienced by the knife as the knife shears material adjacent the orifice plate.

13 Claims, 9 Drawing Sheets

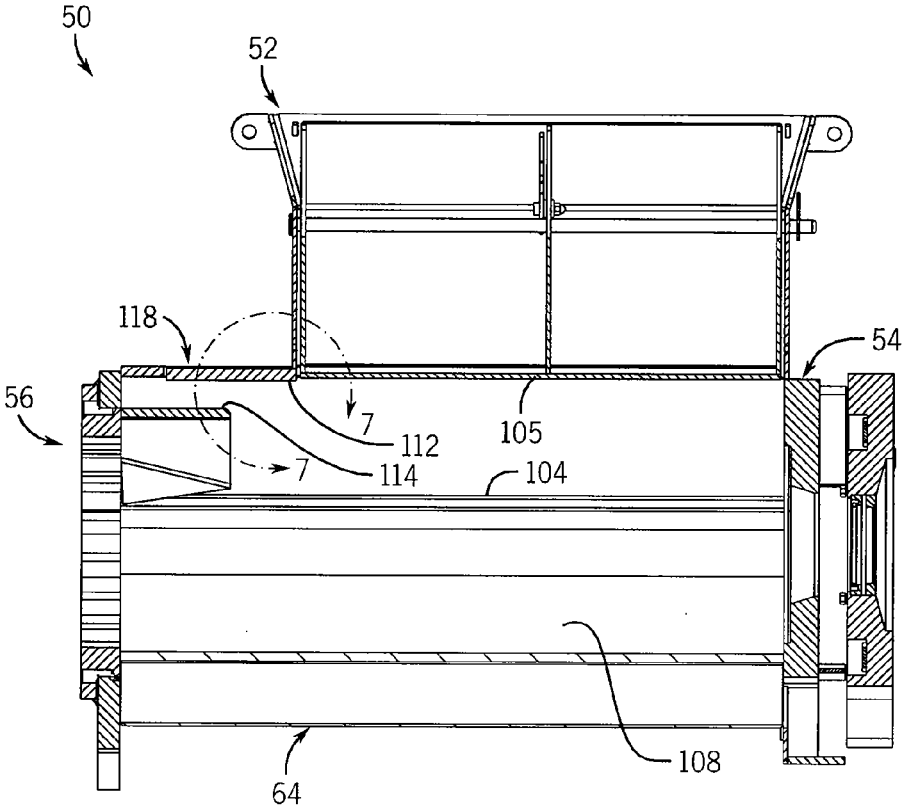
FIG. 6
FIG. 7
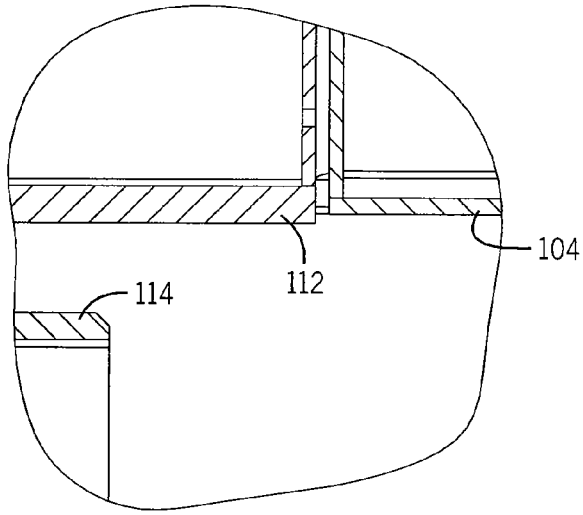

GRINDER WITH EXPANSION ZONE

CROSS-REFERENCE TO RELATED APPLICATIONS

This application is a divisional of application Ser. No. 12/146,146 filed Jun. 25, 2008 titled "Frozen Block Grinder" which issued on May 24, 2011 as U.S. Pat. No. 7,946,517 and which claims the benefit of U.S. Ser. No. 60/946,301, filed Jun. 26, 2007.

BACKGROUND AND SUMMARY OF THE INVENTION

The general structure of grinding machines is well known. Typically, a grinding machine has a hopper into which the material to be ground is placed, a grinder portion, including a grinding head, a mounting ring, a bridge, and a collection tube. A feed screw is located within the grinding head to advance material in the hopper through the head. A knife assembly is mounted at the end of, and rotates with, the feed screw and, in combination with the orifice plate, serves to grind material that is advanced toward the orifice plate by the feed screw. Typically, the orifice plate includes collection passages that lead to a collection cavity defined by a collection cone, which supplies material to a discharge passage. An orifice plate guard is located downstream from the orifice plate and maintains the collection structure in place, and a mounting ring holds a guard against the orifice plate and mounts the intervening structures to the body of the grinding head.

When frozen material is to be ground in a conventional grinding machine, the feed screw rotates in an internal chamber of the hopper to shear the frozen material. The internal chamber is defined by a longitudinal wall spaced from the feed screw. The frozen material is thus translated by the feed screw against the longitudinal wall as the frozen material is moved toward the orifice plate. This can place an undesirable side load on the feed screw. In addition, because the longitudinal wall is relatively smooth, the frozen material slides along the wall as it is moved toward the orifice plate. Moreover, the spacing of the wall from the feed screw can result in chunks that are sheared from the frozen material undesirably bouncing around as the feed screw rotates.

Another drawback of a conventional grinding machine is the limited number of shearing surfaces that are available. More particularly, in a conventional grinding machine, the frozen material can be sheared either by the knife at the forward end of the feed screw or by the pressure flighting on the body of the feed screw as the frozen material is pressed against the longitudinal wall of the internal chamber. However, as the block is reduced and/or the chunks of the block are bouncing around, it is difficult to hold the reduced blocks between the feed screw and the internal chamber wall. As such, reduced blocks of material may be advanced by the feed screw that are larger than desired.

Another drawback of conventional hoppers is the lack of post-reduction but pre-discharge volume. More particularly, a frozen block placed into the hopper will occupy a given volume. As the frozen block is sheared and thus reduced, the collective volume for all the reduced portions of the block will be greater than the volume originally occupied by the whole block. This is a result of air pockets that form between the sheared portions.

As noted above, conventional grinding machines use a knife positioned at a forward end of the feed screw. The knife is positioned in a knife holder that is coupled to the feed screw. The knife is an effective shearing tool as long as it is capable of withstanding the torsional loads placed on the knife during the shearing or grinding process.

Therefore, in accordance with one aspect of the invention, the internal chamber of a grinding machine includes one or more shearing edges that provide fulcrum points against which frozen blocks of material can be held to assist with shearing of the frozen blocks by a feed screw. The shearing edges may be arranged to limit the advancement of over-sized blocks by the feed screw.

In accordance with another aspect, the invention provides a grinding machine having a transition or expansion zone into which frozen material may be fed by the feed screw before ultimately being discharged by further advancement of the feed screw. The transition zone is designed to accommodate the increased volume of material that results as a frozen block is reduced.

In accordance with a further aspect of the invention, a feed screw for use with a grinding machine includes fins designed to provide support for a knife as the feed screw is rotated and the knife shears frozen material against the orifice plate.

It is therefore an object of the invention to provide a grinding machine that provides improved shearing efficiency.

It is another object of the invention to provide a grinding machine that provides improved control of the blocks as the blocks are moved toward the discharge of the grinding machine.

It is a further object of the invention to provide a knife holder that provides improved support for the torsional loads placed on a shearing knife used to shear frozen material.

Various other features, objects and advantages of the present invention will be made apparent from the following detailed description taken together with the drawings, which together disclose the best mode presently contemplated of carrying out the invention.

BRIEF DESCRIPTION OF THE DRAWINGS

Preferred exemplary embodiments of the invention are illustrated in the accompanying drawings, in which like reference numerals represent like parts throughout, and in which:

FIG. 6 is a longitudinal section view of the portion of the grinding machine shown in FIG. 4;

FIG. 7 is an enlarged view of a portion of that shown in FIG. 6 taken along line 7-7 of FIG. 6;

DETAILED DESCRIPTION

Figure 1:
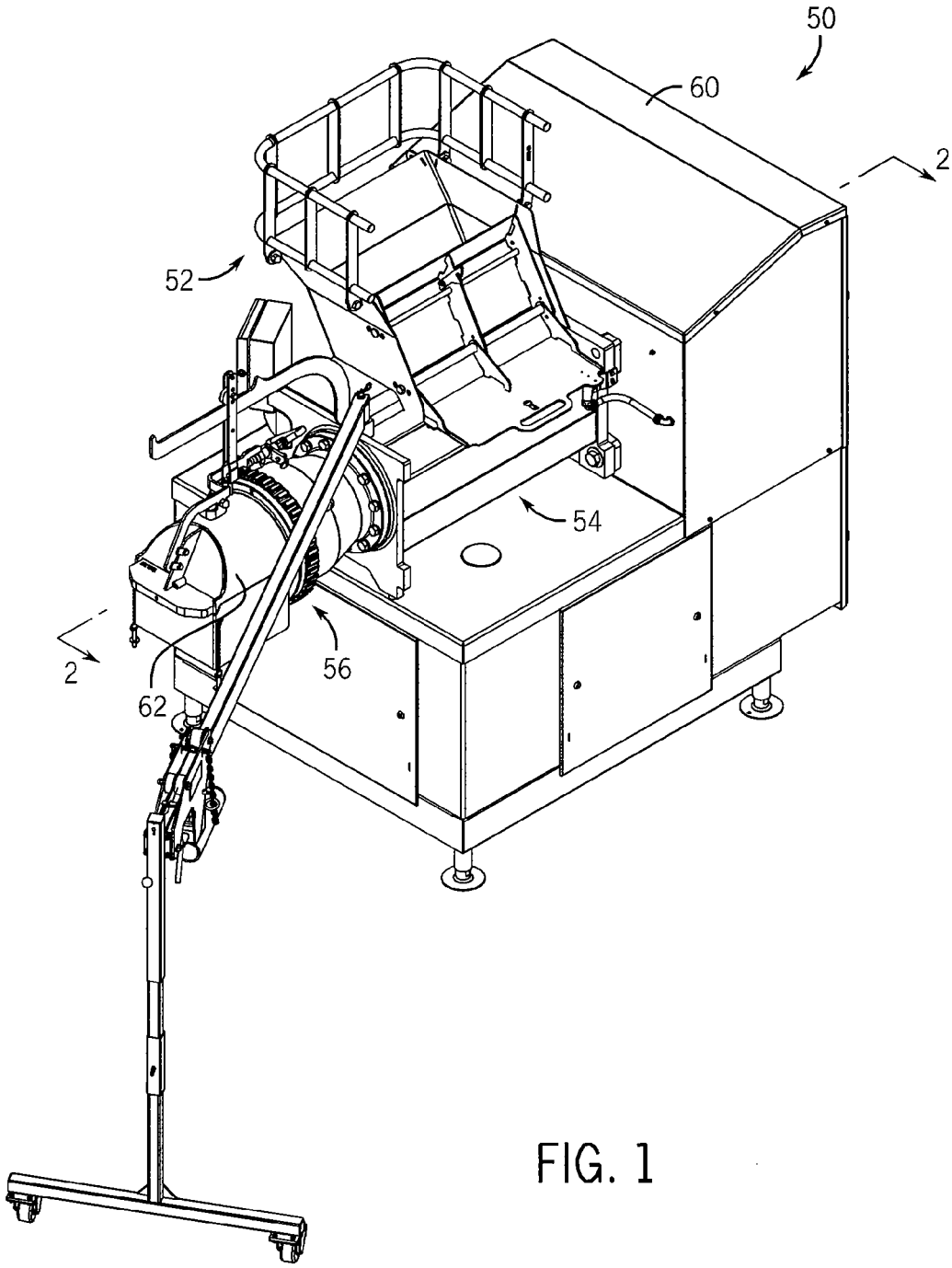
FIG. 1 is an isometric view of a grinding machine incorporating the various aspects of the present invention.

Referring to FIG. 1, grinding machine 50 has a hopper section 52 and a grinder section 54 which are designed to receive and reduce material, which may be frozen blocks of an edible material such as frozen beef, pork, poultry, or fish. The frozen blocks are reduced by a feed screw assembly 56, which includes a feed screw 58, shown in FIG. 2, and which extends through the grinder section 54. The feed screw assembly 56 includes a drive motor contained within a motor housing 60 that is designed to rotate the feed screw 58. The grinding machine 50 also includes a bulkhead 62 into which the reduced material is fed and collected, as known in the art. It is understood that the grinding machine 50 illustrated is representative and that the present invention may be used with other types of grinding machines.

Figure 2:
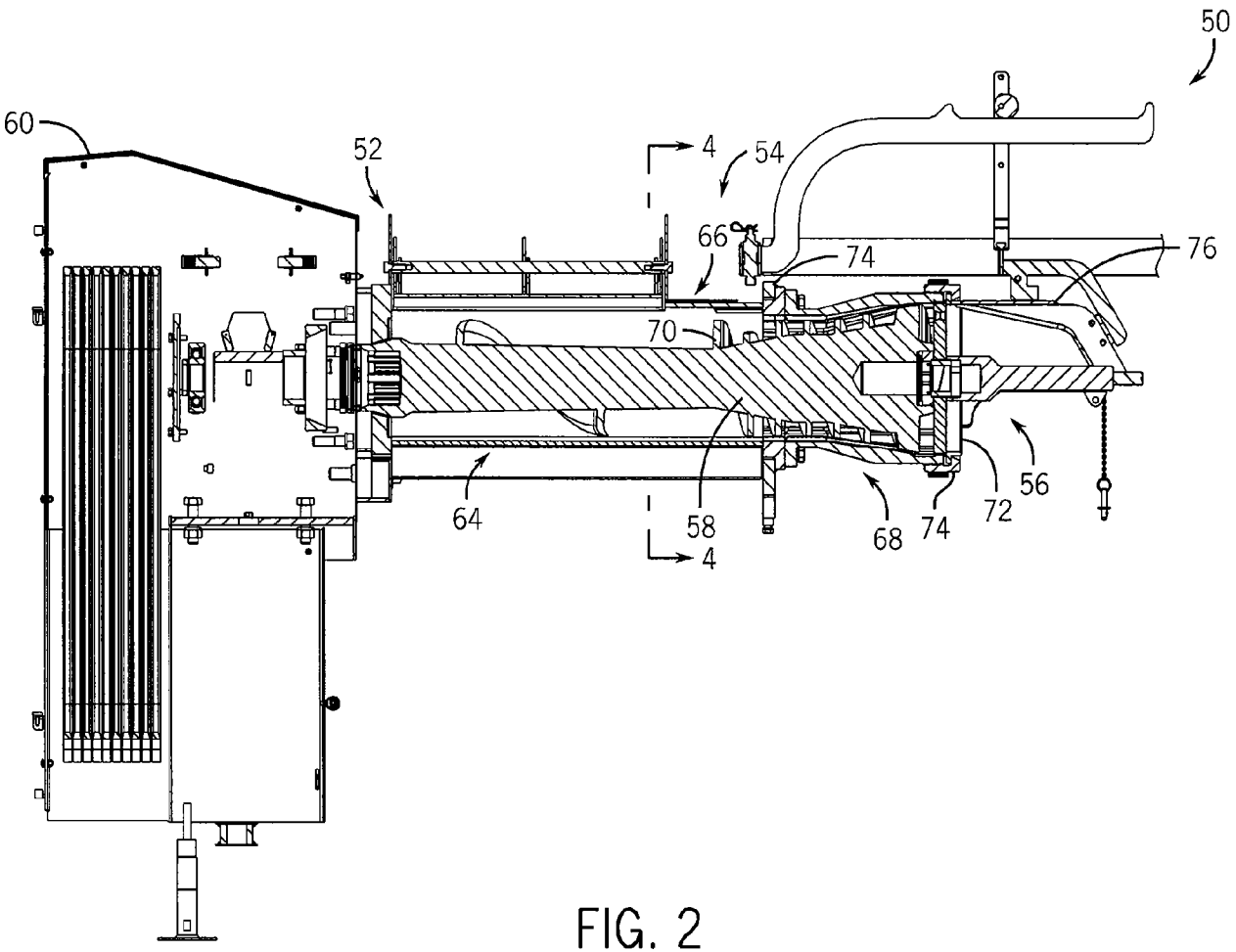
FIG. 2 is a section view of the grinding machine of FIG. 1 taken along line 2-2 of FIG. 1.

Referring now to FIG. 2, grinder section 54 includes a main housing section 64 and a feed section 66. A grinding head section 68 extends forwardly from feed section 66. Feed screw 58 extends throughout the length of main housing section 64, feed section 66 and grinding section 68. Feed screw 58 includes pressure Righting 70 that advances the material through main housing section 64 and through feed section 66 and grinding section 68 upon rotation of feed screw 58. An orifice plate 72 is secured to the end of grinding section 68 via a mounting ring 74, in a manner as is known. A bridge 76 extends outwardly from mounting ring 74.

Feed section 66 is generally tubular and extends forwardly from main housing section 64. Feed screw 58 and feed section 66 are configured such that the end of feed screw 58 extends outwardly from feed section 68 and through grinding section 68, such that the end of feed screw 58 is located adjacent to the inner surface of orifice plate 72.

Figure 3:
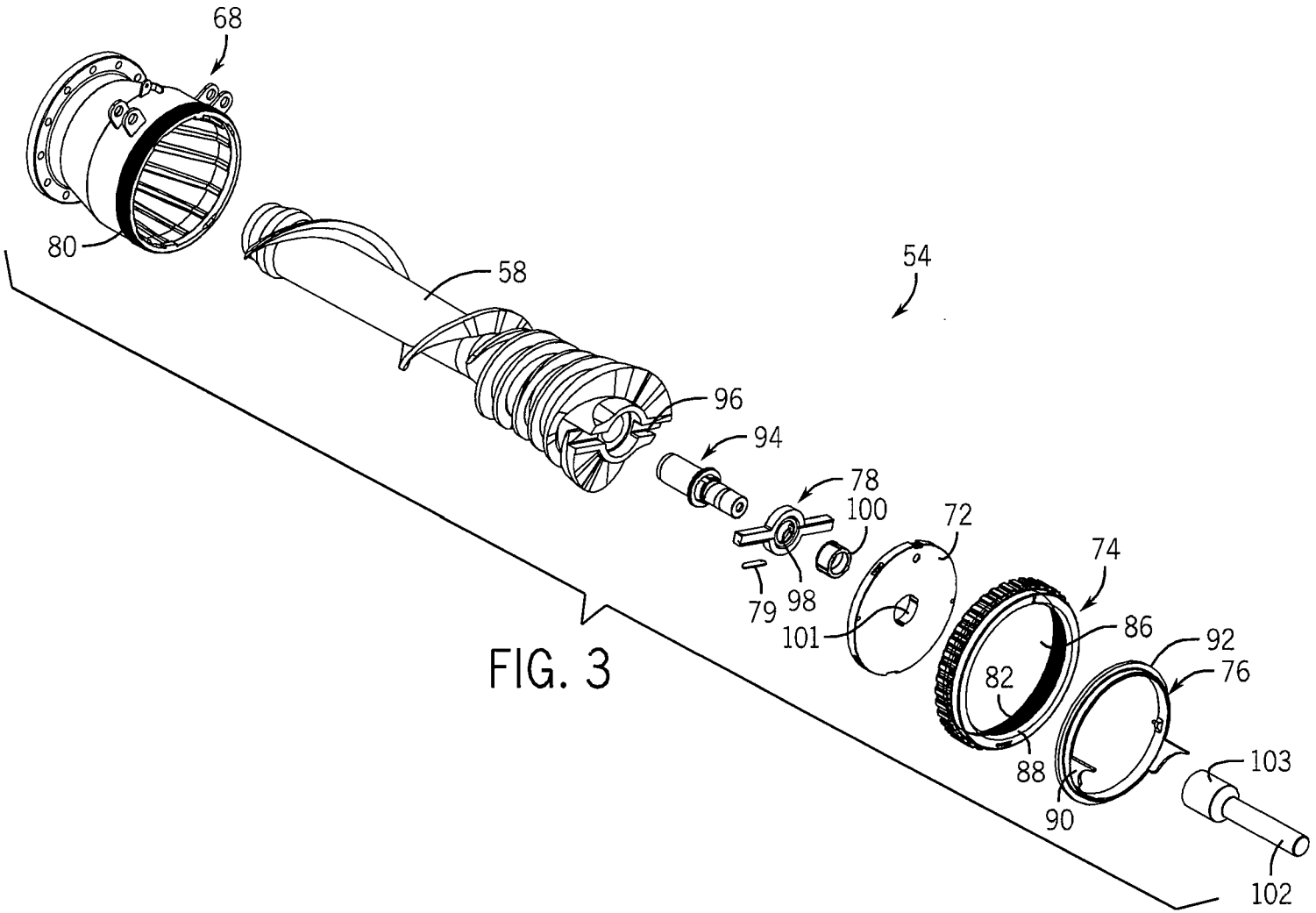
FIG. 3 is an exploded view of a grinder section of the grinding machine of FIG. 1.
Figure 4:
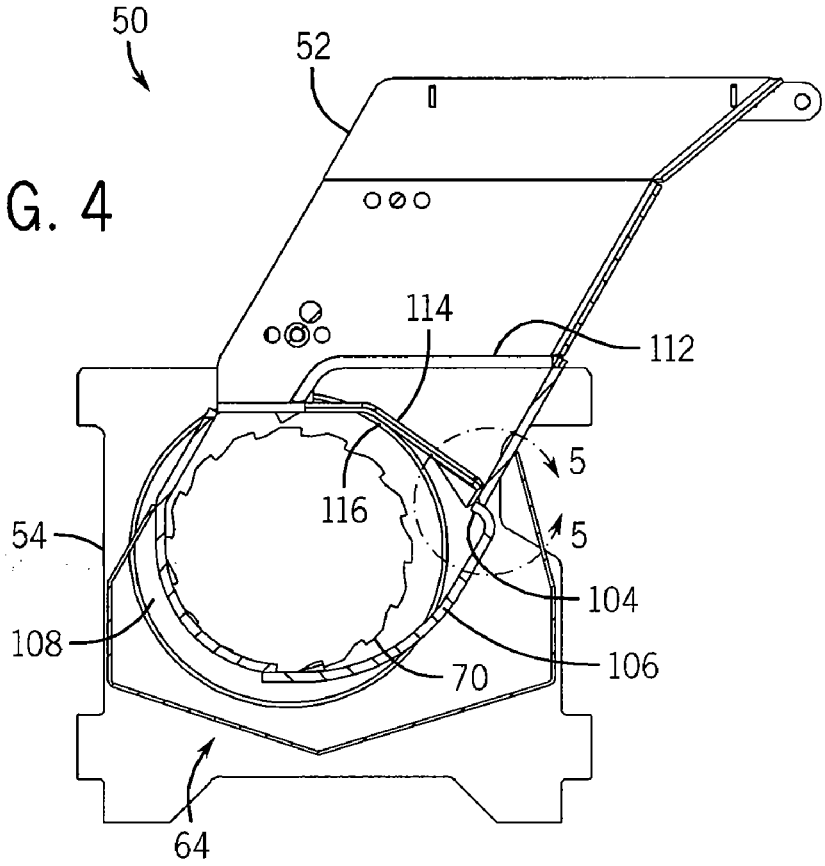
FIG. 4 is an partial section view of a portion of the grinding machine of FIG. 1, taken along line 4-4 of FIG. 2.
Figure 5:
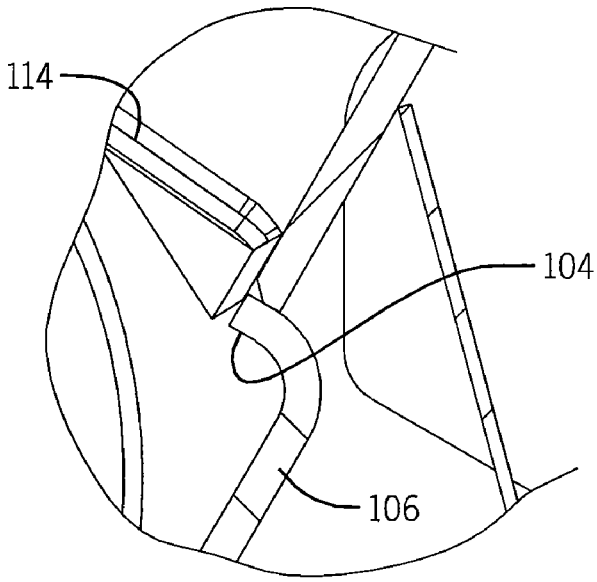
FIG. 5 is an enlarged view of a portion of that shown in FIG. 4 taken along line 5-5 of FIG. 4.
Figure 8:
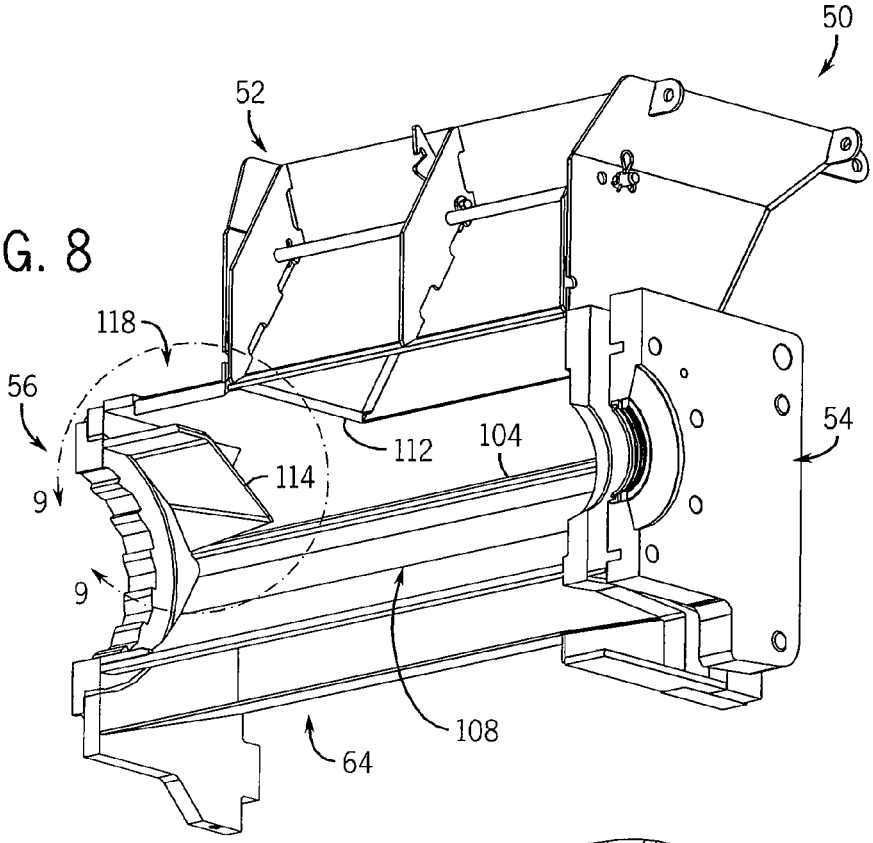
FIG. 8 is cut-away isometric view of the portion of the grinding machine shown in FIG. 5.
Figure 9:
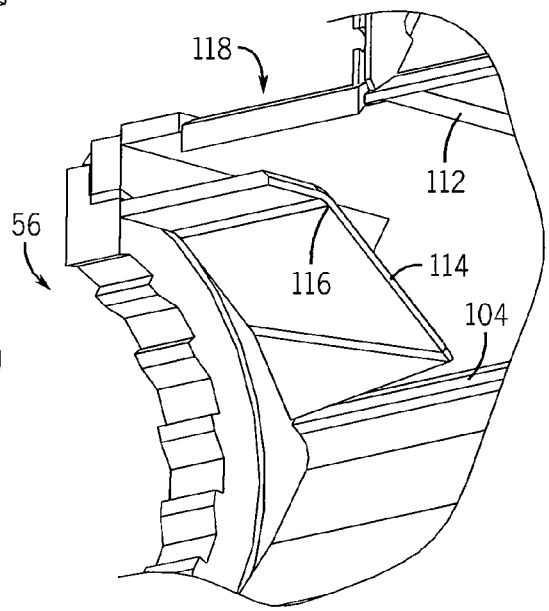
FIG. 9 is an enlarged view of that shown in FIG. 8 taken along line 9-9 of FIG. 8.

Referring now to FIG. 3, a knife holder 78 is mounted at the end of, and rotates with, feed screw 58. Knife holder 78 may hold one or more knife blades or inserts 79, in a manner as is known. Knife holder 78 is located adjacent an inner grinding surface of orifice plate 72, which is secured in the open end of head section 66 by mounting ring 74 and bridge 76. The knife inserts 79 bear against the inner grinding surface of orifice plate 72 to shear material as the material is advanced by operation of feed screw 58 from grinding section 68 toward and through the orifices of orifice plate 72. The end of grinding section 68 is provided with a series of external threads 80, and mounting ring 74 includes a series of internal threads 82 adapted to engage external threads 80 of feed section 68. Mounting ring 74 further includes an opening 86 defined by an inner lip 88. While a threaded connection between mounting ring 74 and feed section 68 is shown, it is understood that mounting ring 74 and feed section 68 may be secured together in any satisfactory manner.

Bridge 76 includes an outer plate maintaining portion 90, which has an outwardly extending shoulder 92 adapted to fit within lip 88 so that bridge 76 is held within ring 74. Shoulder 92 engages the outer peripheral portion of orifice plate 72 to maintain orifice plate 72 in position within the open end of grinding section 68.

A center pin 94 has its inner end located within a central bore 96 formed in the end of feed screw 58, and the outer end of center pin 94 extends through a central passage 98 formed in a central hub area of knife holder 78 and through the center of a bushing 100. Bushing 100 is received within an opening 101 in orifice plate 72 and supports center pin 94, and thereby the outer end of feed screw 58. Center pin 94 is keyed to feed screw 58 by means of recessed keyways on center pin 94 that correspond to keys on the hub of knife holder 78. An inner portion 102 of bridge 76 defines a pin support 103 within which the end of a center pin 94 is received. With this arrangement, center pin 94 rotates in response to rotation of feed screw 58, driving knife assembly 78. Bushing 100 and orifice plate 72 remain stationary, and rotatably support the end of center pin 94.

As noted above, feed section 68 provides an internal chamber in which feed screw 58 rotates to shear the frozen block material. Conventionally, the internal chamber is defined by a wall along which chunks of material, which are sheared from the frozen block of material, are moved through main section 64. The sheared chunks of material typically rotate upon rotation of the feed screw 58 until discharged.

Referring now to FIGS. 4-9, feed section 68 has a primary longitudinal shear edge 104. The shear edge 104 runs along the length of the main section 64, and is positioned generally along the backside 106 of an internal chamber 108 defined by main section 64. As particularly illustrated in FIG. 6, the shear edge 104 is positioned below the inlet 105 into the chamber 108. As the feed screw 58 rotates counter-clockwise within chamber 108, sheared chunks of frozen material will be rotated along with the pressure flighting 70 of the feed screw 58, similarly in a counter-clockwise direction. As the sheared chunks are rotated they will be forced against the primary shear edge 104. The primary shear edge 104 thus effectively provides a pinch point against which the frozen blocks are forced and held. As such, the primary shear edge 104 provides a fulcrum point against which further shearing of the frozen blocks may take place, thereby reducing the side load on the feed screw 58. Primary shear edge 104 is also effective in holding the frozen chunks in internal chamber 108, thereby avoiding the "bouncing around" allowed by conventional hopper and grinder assemblies in which the hopper wall is tangential to the housing wall.

In addition, feed section 68 includes a secondary shear edge 112 at the forward end of main section 64, which provides an additional fulcrum point against which a frozen block of material may be sheared as the material is advanced from main section 64 toward feed section 66. While the primary shear edge 104 extends longitudinally along the length of the main section 64, secondary shear edge 112 extends transversely relative to the longitudinal axis of the feed section 66 and, as shown in FIG. 7, extends to a plane that is below that of the shear edge 104. The secondary shear edge 112 extends transversely across the internal chamber 108, at the forward area of internal chamber 108, upstream of feed section 68. As such, in addition to providing an additional point against which frozen blocks may be held for improved shearing, the secondary transverse shear edge 112 prevents frozen blocks from being prematurely translated forward by the feed screw 58, since the blocks of material must be reduced to a size that is less than the distance between the underside of the shear edge 112 and the exterior surface of the feed screw 58.

In yet a further aspect, head section 66 includes a tertiary shear edge 114 forward of the secondary shear edge 112 (relative to the front of the feed screw 58) that provides an additional fulcrum point against which the frozen block material may be held. In addition, the tertiary shear edge 114 prevents frozen blocks from passing to the front of the head section 66 until they are reduced to a size that allows them to fit between the underside of the shear edge 114 and the exterior surface of the feed screw 58. Moreover, for blocks sized to fit between the tertiary shear edge 114 and the feed screw 58, the underside of the shear edge 114 is angled to form an axially extending pinch point 116, as shown particularly in FIGS. 8-9, against which a block may be forced by the pressure flights 70 of the feed screw 58 for additional shearing.

It is understood that the terms "primary", "secondary", and "tertiary" are not terms of relative importance, but simply terms to distinguish the shear edges from one another. Additionally, it is contemplated that the head section 66 may be constructed to have one, all, or some combination of the primary, secondary, and tertiary edges.

As particularly shown in FIG. 6, head section 66 includes an expansion or transition zone 118 defined at the front or discharge end. The expansion zone 118 provides a volume into which reduced blocks may be translated by the feed screw 58 until subsequently discharged by continued translation of the feed screw 58. In addition, the expansion zone 118 is believed to improve material distribution in the head 66 and around the feed screw 58. In one embodiment, the secondary shear edge 112 and the tertiary shear edge 114 are positioned in the expansion zone 118.

Referring now to FIGS. 10-13, according to another aspect of the invention, feed screw 58 has a knife holder reinforcement fin 120 preferably for each arm of the knife holder 78. Each fin 120 forms a wall that is recessed into the feed screw 58 such that a recess 122 is formed between the pair of fins. The recess is adapted and configured to receive the knife holder 78. More particularly, each fin 120 includes a portion that is located behind a respective knife holder arm 124 to provide support for the knife holder arm 124 during the shearing process. This support helps to prevent material flow within the head 66 from forcing the knife holder 78 into orifice plate 72, which otherwise may cause premature wear of the knife inserts. Each fin 120 also includes a portion that is located alongside and parallel to a respective knife holder arm 124, to reinforce the knife holder arm against side loads experienced during the shearing process. Each knife holder arm 124 is slotted to receive a knife or blade 79 in a manner that allows the blades 79 to be easily replaced as needed.

Figure 10:
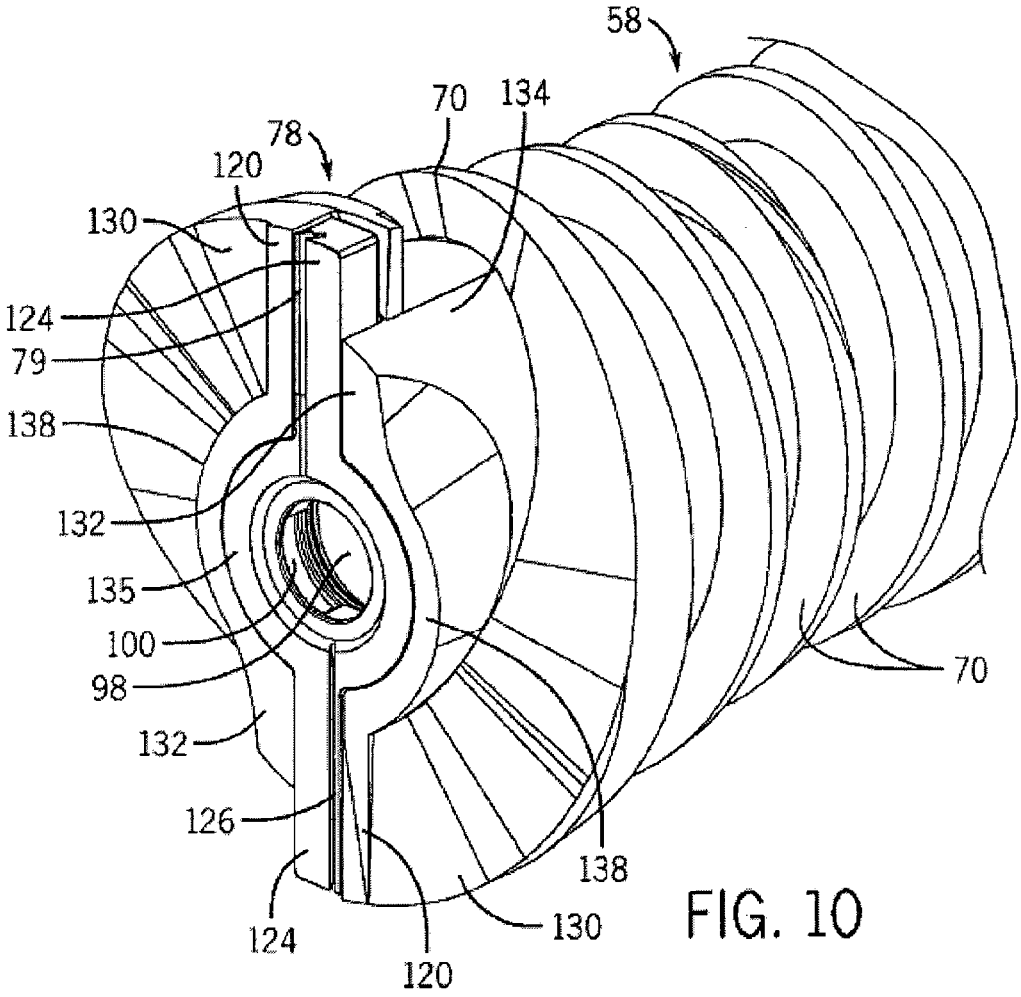
FIG. 10 is an isometric view of an end portion of a feed screw for use with the grinding machine of FIG. 1 and having a knife holder according to one embodiment of the invention.
Figure 11:
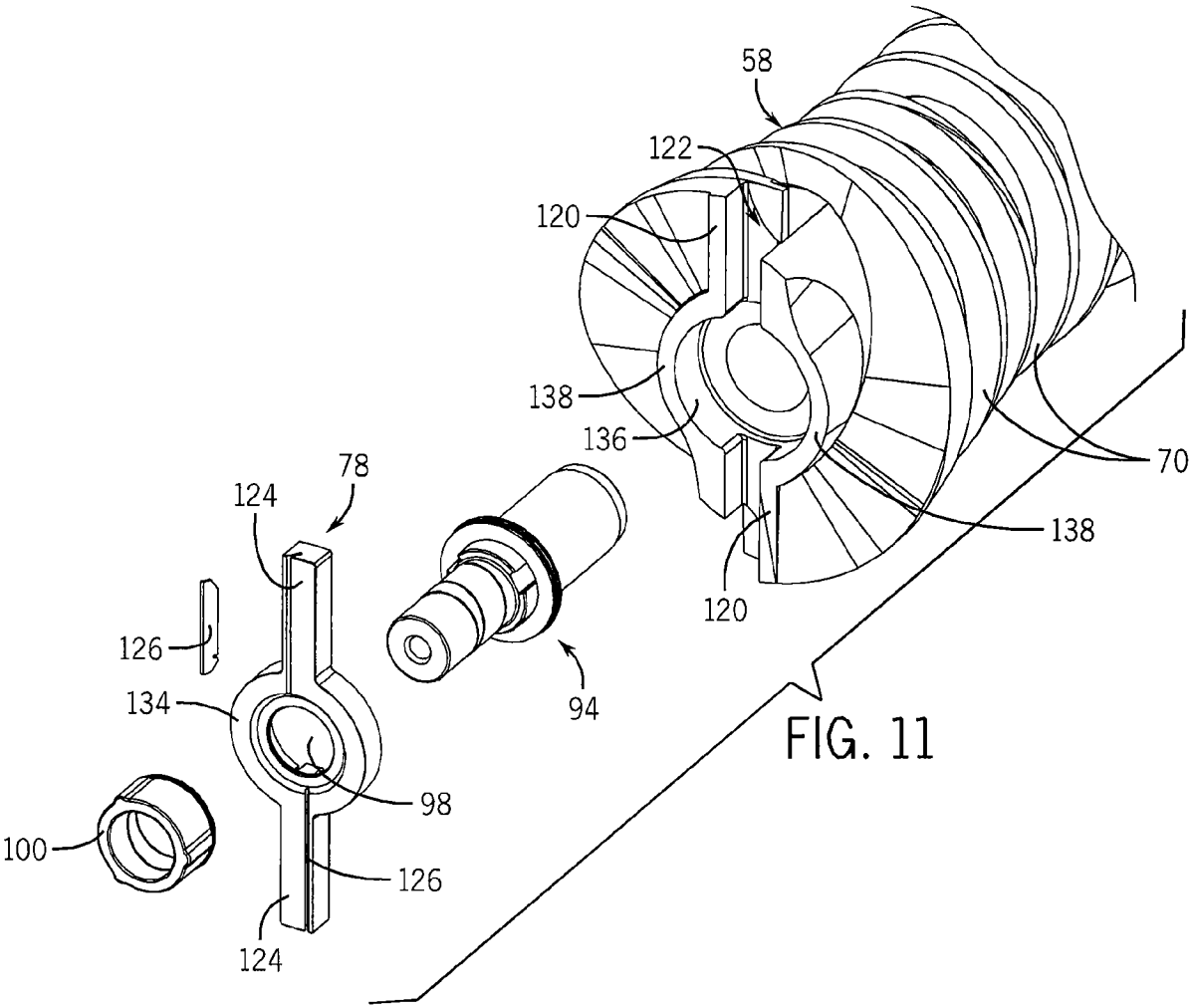
FIG. 11 is an exploded view of that shown in FIG. 10.
Figure 12:
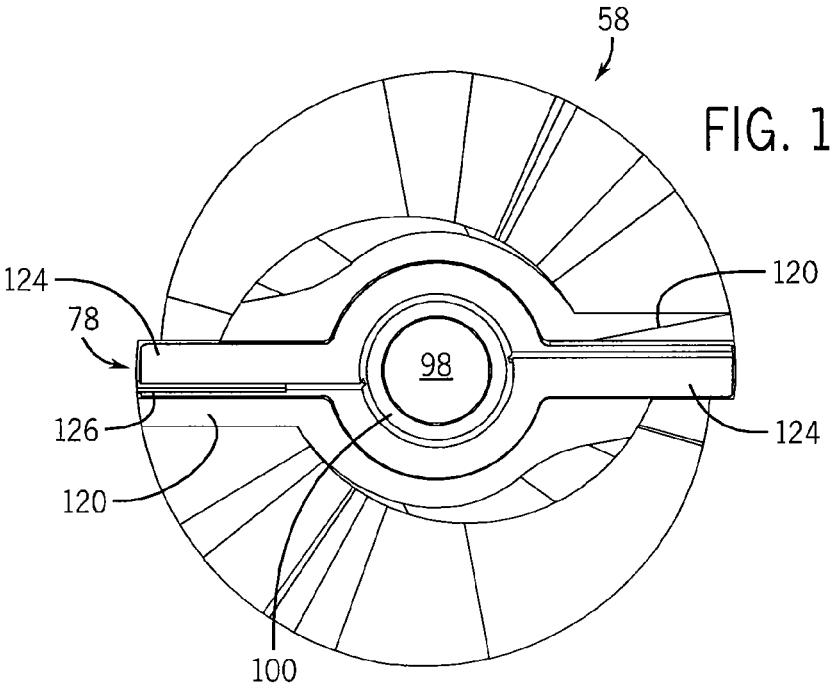
FIG. 12 is an end view of the feed screw shown in FIG. 10.
Figure 13:
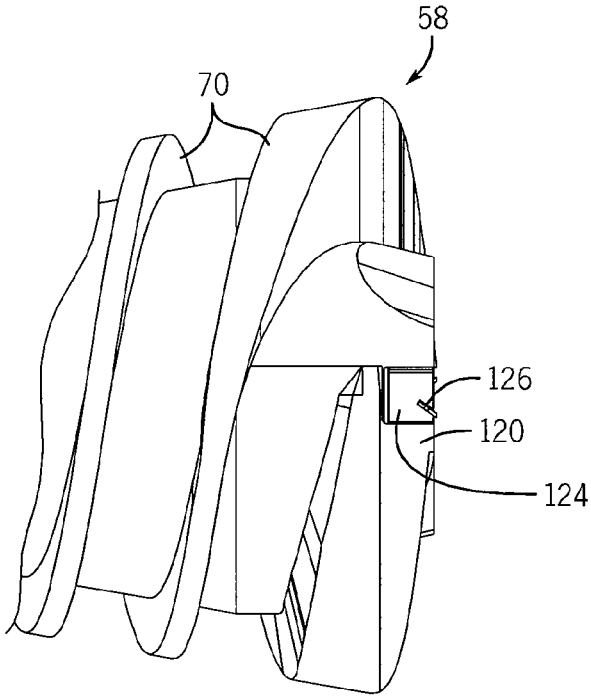
FIG. 13 is an elevation view of the feed screw shown in FIG. 10.

Referring to FIG. 10, each fm 120 is specially configured to relieve side loads experienced by the knife holder arms 124. The fighting 70 of auger 58 defines a pair of ramped end areas 130, and each fin 120 is at the end of one of the ramped end areas 130. On the leading side of knife arm 124, the fin 120 extends radially outwardly to the outer edge of the auger fighting 70 so as to fully protect the leading side of the knife arm 124. The ramped end area 130 at the end of the fighting 70 leads to the leading side of the fm 120, so that only the portion of the knife insert 179 extending from the fin 120 and the knife holder arm 124 is exposed in order to shear the material against the orifice plate 72.

Auger 58 also defines a pair of outwardly extending arm reinforcement sections 132, each of which is spaced from one of the fins 120. Each arm reinforcement section 132 terminates at a location spaced inwardly from the outer edge of the auger flighting 70. Auger 58 also defines a discharge surface 134 that extends from each arm reinforcement section 132. Each discharge surface 134 is configured to as to route material from the flighting 70 past the portion of the fin 120 located behind the knife holder arm 124, and toward the ramped end area 130 leading to the fin 120 adjacent the opposite knife holder arm 124. Each arm reinforcement section 132 functions to engage its respective knife holder arm 124 in order to rotate the knife holder arm 124 upon rotation of auger 58. In addition, the arm reinforcement section 132 extends throughout a substantial portion of the length of the knife or arm 124, to relieve lateral stresses that may be experienced by the knife holder arm 124 when the material is sheared by the knife inserts 79 against the orifice plate 72. It can thus be appreciated that each arm reinforcement section 132 along the trailing side of the knife holder arm 124, in combination with the portion of the fins 120 that extends the full length of the leading side of the knife holder arm 124, function to form a pocket within which the knife holder arm 124 is received in order to reinforce and protect the knife holder arms 124.

Each knife holder arm 124 extends outwardly from a central hub section 135 which, in the illustrated embodiment, is generally circular. The end of the auger 58 is formed with a generally circular recess 136, which has a shape corresponding to that of hub section 135. The walls defining the recess 136, shown at 138, are formed so as to extend between one of the fins 120 and the opposite reinforcement section 132. With this construction, the hub section 135 is fully encased and protected by the end of auger 58.

Various alternatives and embodiments are contemplated as being within the scope of the following claims particularly pointing out and distinctly claiming the subject matter regarded as the invention.

What is claimed is:

1. A processing machine for reducing material, comprising:

an inlet through which material is fed and an outlet through which reduced material is discharged;

a shearing chamber in communication with the inlet;

a feed screw adapted to rotate within the shearing chamber and reduce the material;

an expansion zone disposed between the shearing chamber and the outlet; wherein at least a portion of the expansion zone defines a cavity that is longitudinally offset from the inlet and radially offset from overlap with the feed screw, the expansion zone being configured to receive reduced material advanced through the shearing chamber by the feed screw before the reduced material is discharged through the outlet.

2. The processing machine of claim 1 wherein the expansion zone is configured to provide a volume into which reduced material may be temporarily held as the volume of the material increases during reduction of the material.

3. The processing machine of claim 1 wherein the shearing chamber has an interior wall and a first shear edge extending laterally from the interior wall and adapted to provide a point against which material may be forced during rotation of the feed screw.

4. The processing machine of claim 3 wherein the shearing chamber further includes a transverse second shearing edge disposed downstream of the first shear edge.

5. The processing machine of claim 1 wherein the feed screw has a leading end adapted to receive a knife holder and a shearing knife, and wherein the leading end has a recess adapted to receive the knife holder.

6. A processing machine for reducing material, comprising:

an inlet through which material is fed and an outlet through which reduced material is discharged;

a shearing chamber in communication with the inlet, wherein the shearing chamber has an interior wall and a first shear edge extending laterally from the interior wall and adapted to provide a point against which material may be forced during rotation of the feed screw, a transverse second shearing edge disposed downstream of the first shear edge, and a transverse third shearing edge located downstream of the second shearing edge; a feed screw adapted to rotate within the shearing chamber and reduce the material; and an expansion zone disposed between the shearing chamber and the outlet and configured to receive reduced material advanced through the shearing chamber by the feed screw before the reduced material is discharged through the outlet.

7. The processing machine of claim 6 wherein the second and third shearing edges are disposed transversely relative to a central longitudinal axis of the shearing chamber.

8. A processing machine for reducing material, comprising:

an inlet through which material is fed and an outlet through which reduced material is discharged;

a shearing chamber in communication with the inlet;

a feed screw adapted to rotate within the shearing chamber and reduce the material, wherein the feed screw has a leading end adapted to receive a knife holder and a shearing knife, and wherein the leading end has a recess adapted to receive the knife holder, wherein the recess is defined by a fin that provides support for a rear surface defined by the knife holder; and an expansion zone disposed between the shearing chamber and the outlet and configured to receive reduced material advanced through the shearing chamber by the feed screw before the reduced material is discharged through the outlet.

9. A processing machine for reducing material, comprising:

an inlet through which material is fed and an outlet through which reduced material is discharged;

a shearing chamber in communication with the inlet;

a feed screw adapted to rotate within the shearing chamber and reduce the material;

an expansion zone disposed between the shearing chamber and the outlet, the expansion zone defining a cross-sectional footprint that is larger than a cross-sectional footprint of the shearing chamber and configured to receive reduced material advanced through the shearing chamber by the feed screw before the reduced material is discharged through the outlet.

10. The processing machine of claim 9 wherein the expansion zone is configured to provide a volume into which only partially reduced material is temporarily held as the volume of the material increases during reduction of the material.

11. The processing machine of claim 9 further comprising a first shear edge that extends in a longitudinal direction along the feed screw and a second shear edge that is oriented transverse to the first shear edge.

12. The processing machine of claim 11 wherein the second shear edge is positioned in the expansion zone and is nearer a longitudinal axis of the feed screw than the first shear edge.

13. The processing machine of claim 12 further comprising a third shear edge positioned in the expansion zone and extending in a transverse direction relative to the second shear edge.

* * * * *